US005314100A

United States Patent [19]

Deaver

[11] Patent Number: 5,314,100

[45] Date of Patent: May 24, 1994

[54] GROUT DELIVERY SYSTEM

[76] Inventor: Jim D. Deaver, P.O. Box 804, Templeton, Calif. 93465

[21] Appl. No.: 951,004

[22] Filed: Sep. 25, 1992

[51] Int. Cl.[5] ..... F04B 17/06

[52] U.S. Cl. ..... 222/626; 222/236; 222/529; 239/525

[58] Field of Search ..... 222/236, 333, 527, 529, 222/626, 75; 239/525, 532

[56] References Cited

U.S. PATENT DOCUMENTS

| | | | |
|---|---|---|---|
| 1,808,804 | 6/1931 | Baldner et al. | 222/236 X |
| 1,956,144 | 4/1934 | Brown | 222/626 |
| 2,134,347 | 10/1938 | Thompson | 239/525 |
| 3,140,801 | 7/1964 | Delligatti . | |
| 3,142,419 | 7/1964 | Burke | 222/236 |
| 3,227,426 | 1/1966 | Williams . | |
| 3,768,939 | 10/1973 | Gramling | 222/626 X |
| 3,806,002 | 4/1974 | Mills et al. | 222/626 |
| 3,889,850 | 6/1975 | Whitt | 222/236 X |
| 4,682,711 | 7/1987 | Reighard et al. | 222/75 |
| 5,122,038 | 6/1992 | Malkoski . | |

*Primary Examiner*—Andres Kashnikow
*Assistant Examiner*—Kenneth Bomberg
*Attorney, Agent, or Firm*—Boniard I. Brown

[57] ABSTRACT

A grout delivery system includes a grout storage hopper connected to a motor-operated pump to pump flowable grout or mortar through a flexible hose into a nozzle structure for application to a work surface. A nozzle handle contains a pushbutton actuator for a pump motor speed control circuit. An operator can observe grout flow from the nozzle while operating the pushbutton to adjust the grout flow rate. The pump motor speed control allows the operator to apply grout at a relatively high rate and with a high degree of accuracy, because the grout flow rate can be increased or decreased, as necessary to fill cracks or crevices of different size.

5 Claims, 2 Drawing Sheets

GROUT DELIVERY SYSTEM

BACKGROUND OF THE INVENTION

1. Field of the Invention

The present invention relates to grout-delivery systems for supplying flowable grout from a storage hopper through a flexible hose to a hand-held nozzle structure for application to a work surface, which may comprise areas bordering bricks, floor tiles, metal doors or metal windows, etc.

2. Prior Art

Systems for delivering grout or wet plaster to work areas are already known. U.S. Pat. No. 3,140,801 to Delligatti discloses a plaster delivery system including a cylindrical supply hopper having vertical axis agitator means driven by an overhead motor. A horizontal gate valve controls downflow of wet plaster from the hopper into the pumping chamber of a piston-operated pump. The pumping piston has a ball check valve to allow the plaster to flow through the piston in the pumping direction.

U.S. Pat. No. 3,227,426 to Williams discloses a grout-delivery system wherein a single electric motor drives a grout-delivery pump and a vertical axis agitator in a grout supply hopper. The power connection includes a power take-off unit having a vertical shaft connected to the agitator, and a horizontal shaft connected to the pump. A clutch is disposed between the horizontal shaft and the pump, whereby the agitator can continue operating while the pump is stopped. The agitation action prevents grout in the hopper from prematurely hardening.

U.S. Pat. No. 3,768,939 to Gramling discloses a mortar delivery system wherein a known Moyno pump is located below a mortar-supply hopper for delivering mortar through a flexible hose and into a specially constructed nozzle which has a projecting guide means and mortar-striking protuberance to facilitate the flow of mortar into the spaces between rows of bricks. The pump motor is turned on or off by means of a pushbutton switch on the nozzle.

U.S. Pat. No. 5,122,038 to Malkoski discloses a grout pumping system that includes a vertical axis agitator means disposed in an upright cylindrical hopper. The pumping unit includes a horizontal axis auger located below the hopper, said auger having an array of rod-like shear blades which recirculate some of the grout back into the hopper, thus to more thoroughly mix the grout ingredients. The pumping unit is formed in separable sections that can be taken apart for cleaning purposes.

There is no provision in the above-noted patented systems for controlling or varying the flow rate of the grout (or plaster) through the nozzle structure. The operator of the nozzle cannot control the amount of mortar or grout discharged onto the work surface. There thus can be spills or smearing of the grout onto unwanted surfaces. At the other extreme, the grout flow rate may be so slow as to interfere with worker productivity.

SUMMARY OF THE INVENTION

The present invention concerns a grout-delivery system wherein the human operator is enabled to vary or adjust the grout flow rate from the grout discharge nozzle. The operator can thus achieve maximum productivity consistent with his capabilities, without danger of spills or smears on unwanted surfaces.

In the preferred practice of the invention, the grout flow rate adjustment is achieved by means of a pushbutton controller located in a handle which extends from the grout discharge nozzle. The operator can observe the grout flow from the nozzle while at the same time varying his thumb pressure on the pushbutton to make desired changes in the grout flow rate. The pushbutton operates an electric slider that transverses a potentiometric resistance that forms part of a motor speed control system for a grout pump motor.

The grout delivery system comprises a grout-supply hopper located above a horizontal axis auger pump driven by a small electric motor. A flexible hose extends from the discharge end of the pump to the aforementioned nozzle. In order to maintain the grout in a desired flowability range, the grout-supply hopper is equipped with internal agitator means driven by a second electrical motor. The second electrical motor is equipped with a two speed control device, whereby the motor may be selectively operated at a relatively high speed or a relatively low speed. The high motor speed is utilized for mixing the grout ingredients, Portland cement and water, initially to form the grout mixture. The low motor speed is utilized for later agitating the grout mixture to prevent separation or stratification of water from the grout mix. Such separation and stratification can undersirably result in localized hardening or stiffening of the grout in the hopper, which makes it difficult to pump the grout through the associated flexible hose.

The operating components of the system are preferably mounted on a small flat bed trailer having an overall width slightly less than the passage width of a conventional door frame (usually thirty-six inches), whereby the trailer can be moved from place to place in a building under construction or repair, the trailer being compact enough to go through doorways or into elevators, thus enabling the trailered system to be taken into small rooms or spaces having need for grout application. With this ability to bring the trailer into close proximity to the grout application work areas, it becomes possible to use a relatively short hose between the pump and the nozzle, as is desirable because a short hose is less prone to pluggage than a longer hose. The trailer can be transported in a pickup truck or hitched to a towing vehicle, according to whichever is most convenient.

DESCRIPTION OF A PREFERRED EMBODIMENT OF THE INVENTION

Figure 2:
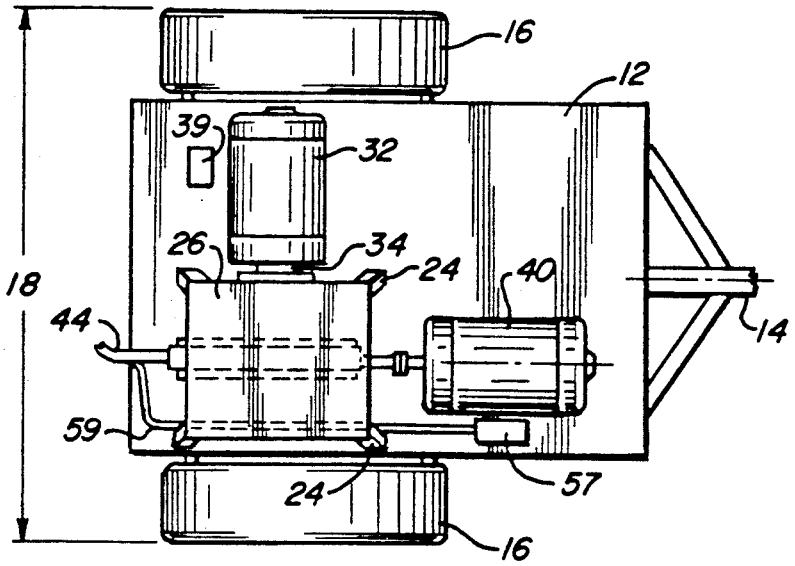
FIG. 2 is a top plan view of the system of FIG. 1.

Referring to FIG. 2 of the drawings, a flat bed trailer 10 forms a horizontal platform or base 12 for the operating components of a grout delivery system embodying the present invention. Platform 12 is supported between two transversely-spaced road wheels 16. A removable tow bar 14 extends forwardly from the platform for towing behind a towing vehicle. A retractable stand (not shown) may preferably be provided under the front portion of the platform 12 to maintain it level during operation of the system.

The overall width dimension 18 of the trailer is preferably no more than about thirty-two inches, whereby the trailer can be moved through building doorways and into elevators. As previously noted, the passage width of a conventional door frame is about thirty-six inches. The front-to-rear length dimension of the trailer may preferably be about thirty inches. The diameter of each roadwheel 16 may be about seventeen inches, thus to elevate platform 12 a sufficient distance for over-the-road movement.

Figure 1:
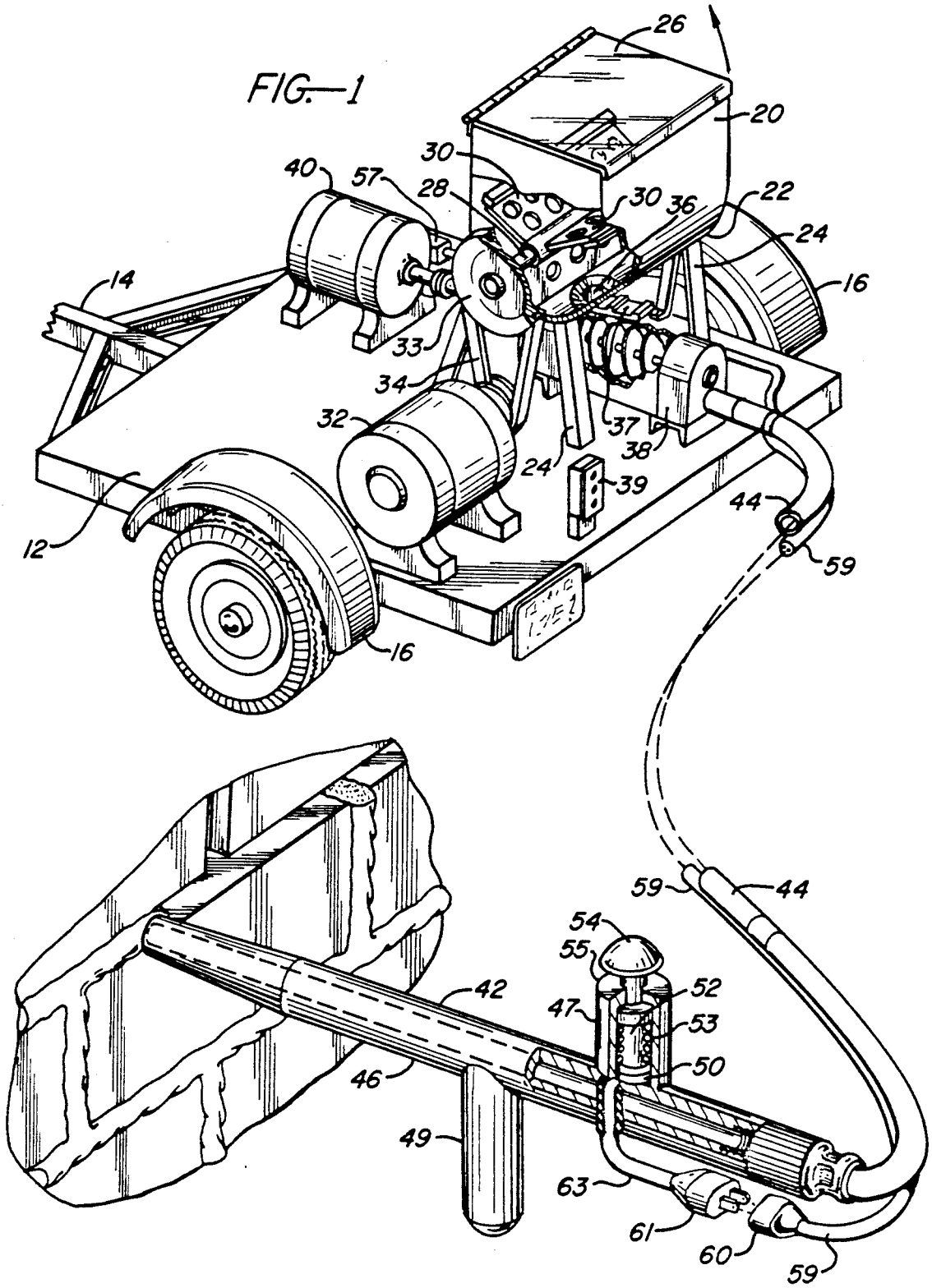
FIG. 1 is a perspective view, partially broken away, of a grout delivery system according to the present invention.

The major operating components of the grout-delivery system are shown in FIG. 1, wherein there is shown a system comprising a grout storage hopper 20 having a curved bottom wall 22 extending normal to two flat end walls. As viewed in FIG. 2, the hopper has a rectangular configuration. The hopper is supported by two vertical leg structures 24 that extend from platform 12 upwardly to connect with the curved bottom wall 22 of the hopper.

Access to the hopper is via a top opening normally closed by a hinged lid 26. The lid may be partly or wholly transparent for viewing the progress of the mixing operation required to produce flowable grout in the hopper, which process involves mixing Portland cement and water, with coloring matter as an option.

A horizontal shaft 28 extends through the hopper to support a three-bladed agitator 30. The agitator blades sweep along the hopper bottom wall to lift and mix the grout ingredients. The axis of shaft 28 coincides with the center of curvature of bottom wall 22.

Power for agitator 30 is provided by an external electric motor 32 mounted on platform 12. The motor drive shaft carries a pulley (shown in FIG. 1). A second pulley 33 is carried on shaft 28 near the hopper side wall. Belt 34 is trained about the two pulleys to transmit power from motor 32 to the agitator in the hopper.

During the mixing of the cement and water to form the grout, motor 32 may be run at a relatively high rate of speed, whereby the mixing process can be accomplished in a reasonably short period of time, i.e., a few minutes. The volumetric capacity of hopper 20 is relatively small, e.g., about five to nine gallons, because the grout will remain in a flowable condition for only about fifteen minutes; after about a fifteen minute shelf life, the grout tends to set up or harden. Therefore, the grout is made in relatively small batches, e.g., five or six gallons, commensurate with the quantity that can be used while still remaining flowable. Mixing the ingredients together at a relatively high agitator speed such as 25 r.p.m. is advantageous in that the mixing operation is then relatively quick, and thus does not adversely effect overall productivity of the grouting process.

During the application of the grout to the work, the grout is gravitationally dispensed from hopper 20 downwardly through a passage 36 that communicates with an auger type pump 38. Rotation of the auger moves the grout in a right-to-left direction (as viewed). As an optional feature, a horizontally slidable gate valve 37 may be provided between the hopper and the pump to halt the flow of grout from the hopper. While the ingredients are being mixed to initially form the grout, valve 37 is in a closed condition. While the grout is being pumped during the grouting process, valve 37 is in the open condition shown in FIG. 1.

In order to prevent premature hardening of the grout in hopper 20, the agitator blades 30 are rotated by motor 32 at a relatively slow speed while pump 38 is operating. Agitator 30 rotation at a slow speed such as 8 r.p.m. in hopper 20 tends to prevent separation or stratification of the water, and thus deters premature stiffening of the grout.

Agitator blades 30 are axially dimensioned to be equivalent to the corresponding dimension of hopper 20, thus enabling each blade 30 to scrape the entire curved surface 22 to prevent grout or grout ingredients from remaining on the curved surface where the same could prematurely harden into a non-flowable condition. The material lifted from surface 22 is mixed with the larger mass of grout materials to achieve and maintain a relatively homogeneous grout mix.

Motor 32 is used to power both the mixing and the later agitation of the grout. Motor 32 is therefore a two-speed motor, i.e., a motor having a high speed for ingredient mixing and a low speed for grout agitation. The motor is controlled by a manual selector switch 39 (FIG. 2) having an off position, a high speed position, and a low speed position.

The auger pump 38 is driven by an electric motor 40 that is capable of operating at varying speeds, whereby the grout flow rate through the pump can vary in accordance with variations in demand at the grout discharge nozzle 42 (FIG. 1). The pump is connected to the nozzle via a flexible hose 44, and the grout flows from the pump through hose 44, and through the nozzle.

The nozzle shown in the drawings comprises a straight tubular flow duct 46 having a handle element 47 projecting upwardly, whereby a person operating the nozzle can grasp the handle with one hand. The person's other hand encircles a second handle 49 for manipulating and controlling the nozzle.

Figure 3:
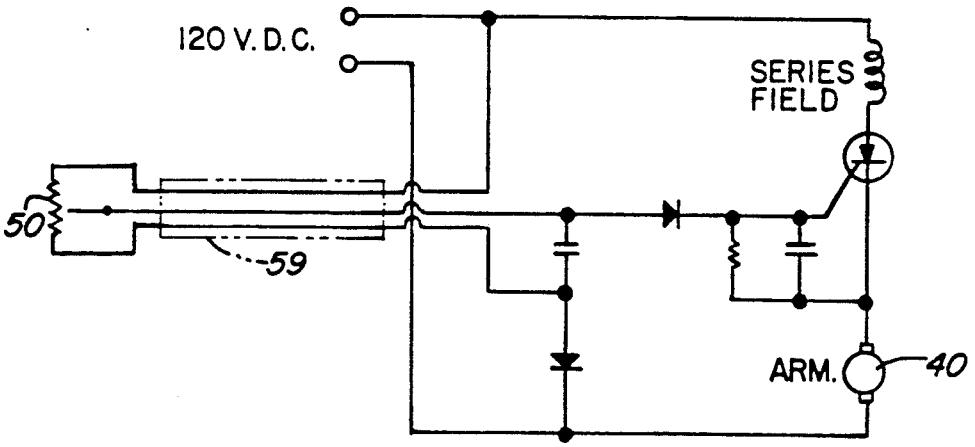
FIG. 3 is an electrical schematic diagram of a motor speed control circuit utilized with the invention for varying the speed of a pump motor.

Slidably mounted in handle element 47 is a spring-biased pushbutton 54 having a stem 52 that extends downwardly into and along a potentiometric resistance 50, said potentiometric resistance forming part of the motor control circuit of FIG. 3. The upper end portion of pushbutton 54 projects outwardly through an end cap 55 on handle 47, whereby the person can apply thumb pressure on the pushbutton to move the button toward a position fully telescoped into the handle, against the biasing force of pushbutton spring 53. Pushbutton motion operates or adjusts the potentiometric resistance to vary its voltage divider action, thus to vary the speed of electric motor 40.

The FIG. 3 control circuitry may be housed in an electrical box 57 (FIG. 2) on platform 12 near motor 40. A cable 59 extends from the box leftwardly along platform 12 and then along hose 44 to a point in proximity to nozzle structure 42 (FIG. 1). The cable terminates in a multi-pronged connector 60 adapted to mate with a female connector 61 carried on nozzle structure 42. Connectors 60, 61 may be physically disconnected when it becomes necessary to disconnect the nozzle structure from hose 44, e.g., for cleaning purposes. A short cable 63 provides a continuing electrical connection between the slider-potentiometric resistance and connector 61.

The cable system transmits electric control signals between the motor speed control circuit and the pushbutton control circuitry on nozzle 42, whereby the person operating the nozzle can observe the grout flow from the nozzle, and can depress or lift pushbutton 54 to make any changes required in the grout flow. The control system is advantageous in that it allows the operator to precisely control grout flow, i.e., to increase the flow where necessary or to decrease the flow should that be necessary. The person can thus dispense grout onto the work surface cracks or into crevices in accordance with his physical ability to manipulate the nozzle or distribute the grout properly.

Thus there has been shown and described a novel grout delivery system which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A system for delivering grout to a grout application work area, comprising:

a grout storage hopper, grout pumping means disposed below said hopper, said pumping means comprising a variable speed electric motor, a passage means for conveying grout from said hopper to the pumping means, a flexible hose having one end thereof connected to the pumping means, whereby grout flows through said hose when the pumping means is operating, a hand-held nozzle structure connected to the other end of said flexible hose for applying the flowing grout to the work area, said nozzle structure comprising a tubular flow duct, a first handle element projecting from said flow duct in a first direction, and a second handle element projecting from said flow duct in a second direction opposite to said first direction, whereby a person can grasp both handle elements for manipulating the nozzle structure, and means for varying the speed of said pump motor to vary the grout flow rate through said nozzle structure, said motor speed-varying means comprising a potentiometric resistance in the first handle element, a pushbutton actuator slidably mounted in said first handle element, and an electrical slider carried by said pushbutton for traversing said potentiometric resistance in response to slidable movement of the pushbutton actuator, whereby a person holding the nozzle structure can vary the motor speed while observing the grout flow out of the nozzle structure.

2. A system for delivering grout to a grout application work area, comprising:

a grout storage hopper, grout pumping means disposed below said hopper, said pumping means comprising a variable speed electric motor, a passage means for conveying grout from said hopper to the pumping means, a flexible hose having one end thereof connected to the pumping means, whereby grout flows through said hose when the pumping means is operating, a hand-held nozzle structure connected to the other end of said flexible hose for applying the flowing grout to the work area, means for varying the speed of said pump motor to vary the grout flow rate through said nozzle structure, said motor speed-varying means comprising a pushbutton actuator mounted on the nozzle structure, whereby a person holding the nozzle structure can vary the motor speed while observing the grout flow out of the nozzle structure.

grout-agitator means in said hopper, a second electric motor operatively connected to rotate said agitator means within the hopper, and a two-speed control means for said second motor, whereby said second motor may be operated at a relatively high speed for mixing the grout ingredients to form the grout, and said second motor can be operated at a relatively low speed for agitating the grout to prevent a water-cement separation condition.

3. A grout delivery system according to claim 2, wherein said grout-agitator means comprises:

a horizontal agitator shaft extending transversely through said hopper, and a plurality of agitator blades radiating from said agitator shaft within said hopper, said hopper having a curved bottom wall, said agitator shaft being disposed on the center of curvature of the hopper bottom wall, whereby the agitator blades sweep along the hopper bottom surface to thoroughly mix and agitate the grout ingredients.

4. A grout delivery system according to claim 3, and further comprising:

a trailer having a flat bed supported on two transversely-spaced road wheels, said grout storage hopper, pumping means and agitator motor being mounted on the trailer flat bed.

5. A grout delivery system according to claim 4, wherein the overall width of said trailer is less than the passage width of a conventional door frame, whereby the trailer may be moved from place to place through doorways within a building structure.

* * * * *